US005139109A

United States Patent [19]

Clarke

[11] Patent Number: 5,139,109

[45] Date of Patent: Aug. 18, 1992

[54] LADDER LEVELLING DEVICE

[76] Inventor: James B. Clarke, 120 Shepherds Hill, Harold Wood, Essex RM3 ONJ, England

[21] Appl. No.: 634,869

[22] PCT Filed: Jul. 6, 1989

[86] PCT No.: PCT/GB89/00767

§ 371 Date: Jan. 7, 1991

§ 102(e) Date: Jan. 7, 1991

[87] PCT Pub. No.: WO90/00665

PCT Pub. Date: Jan. 25, 1990

[30] Foreign Application Priority Data

Jul. 13, 1988 [GB] United Kingdom ..... 8816599

[51] Int. Cl.[5] ..... E06C 7/44

[52] U.S. Cl. ..... 182/200; 182/108

[58] Field of Search ..... 182/107, 108, 200, 201

[56] References Cited

U.S. PATENT DOCUMENTS

| | | | |
|---|---|---|---|
| 2,708,543 | 5/1955 | Matich . | |
| 3,086,612 | 4/1963 | McKinley . | |
| 3,618,703 | 11/1971 | Wilke | 182/107 |
| 3,993,275 | 11/1976 | Lucas . | |
| 4,069,890 | 1/1978 | Gottliebsen | 182/107 |
| 4,230,202 | 10/1980 | Kudra . | |
| 4,304,318 | 12/1981 | Webb | 182/107 |
| 4,648,482 | 3/1987 | Kitson | 182/108 |
| 4,699,247 | 10/1987 | Clarke | 182/200 |

FOREIGN PATENT DOCUMENTS

| | | |
|---|---|---|
| 2542802 | 9/1984 | France . |
| 2156415 | 10/1985 | United Kingdom . |
| 2160570 | 12/1985 | United Kingdom . |
| 85/02650 | 6/1985 | World Int. Prop. O. . |

*Primary Examiner*—Reinaldo P. Machado

[57] ABSTRACT

A device for supporting the lower ends of ladder stiles on unlevel ground comprises a flat flexible mat (7) having at one end a ramp portion (1). In use, one stile rests on the flat mat and the other rests, at an appropriate height on the ramp portion, which faces the wall against which the ladder leans.

4 Claims, 2 Drawing Sheets

LADDER LEVELLING DEVICE

Conventional lean to ladders have two stiles which at their bottom ends act as legs for resting on the ground. When the ground slopes sideways one leg has to be packed underneath to keep it steady. Such loose packing, frequently in the form of a tile or wedge, can easily be dislodged.

Most proprietary ladder levelling devices are expensive mechanical gadgets, and as fixtures render the ladder too awkward to use and slow to adjust. One notable exception is a ladder leveller in the form of a ramped rigid platform on three ground engaging feet for simultaneously supporting both free standing ladder legs. The ladder leveller cannot be casually separated from the ladder when either ladder leg lifts in use. The rigid structure of this device has to be strong to span the three individual feet and is relatively expensive to fabricate.

In accordance with the invention, a ladder levelling device comprises a flexible mat for laying in position on the ground, the upper surface of the mat being provided with a graded range of heights from the ground, the arrangement being such that both ladder legs may simultaneously be placed upon the upper surface and, by altering the position of one or both legs relatively to the upper surface, the legs may be spaced at mutually varying different heights from the ground.

The flexibility of the mat ensures that those positions in use at any given time conform to irregular ground for maximum support beneath each leg.

A suitably sized rectangular mat with a wedge shaped section throughout would perform the task, but would require an inordinate amount of material, and would require careful and difficult orientational manipulation of the mat under the ladder.

Preferably, therefore, the upper surface of the mat provides a substantially flat portion for supporting one ladder leg, and the graded range of heights is provided for supporting the other ladder leg. This arrangement is economical of material and most advantageously allows movement of the ladder as opposed to the device for adjusting the ladder.

The graded range of heights may be provided by an integral portion of the mat, or by a separate ramp portion which is located on the mat and may then be adjustable to allow for right or left-handed operation. For example, the mat may be elongate and the ramp portion rotatably mounted on one end of the mat. The ramp may then be used inclined downwards towards a wall against which the ladder is leaning, under either one of the ladder stiles.

One example of a device constructed in accordance with the invention is illustrated in the accompanying drawings, in which.

Figure 1:
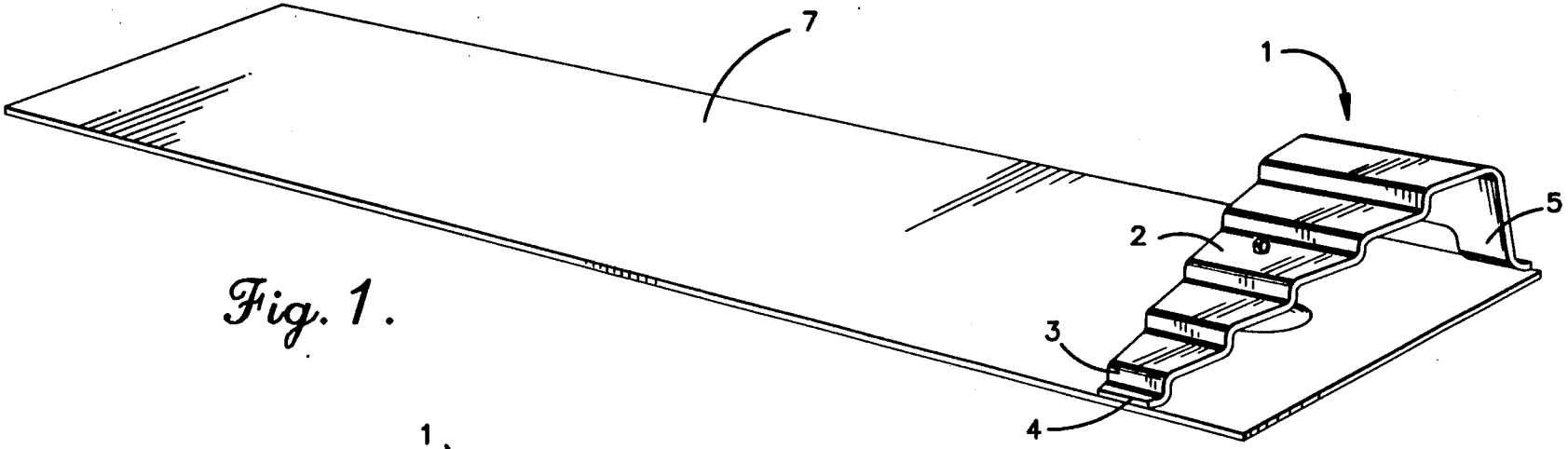
FIG. 1 is a perspective view.
Figure 2:
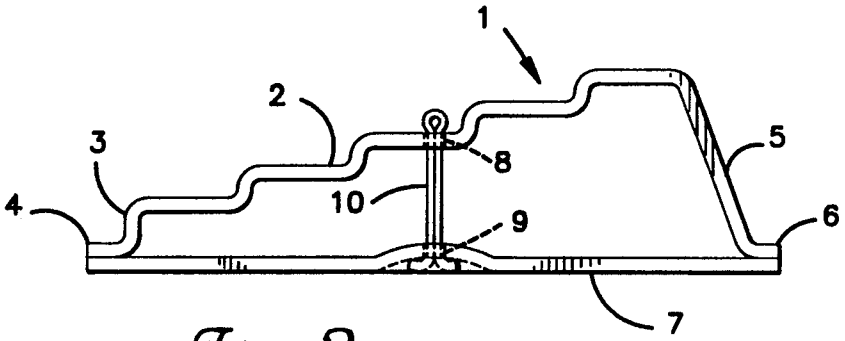
FIG. 2 is an end elevation
Figure 3:
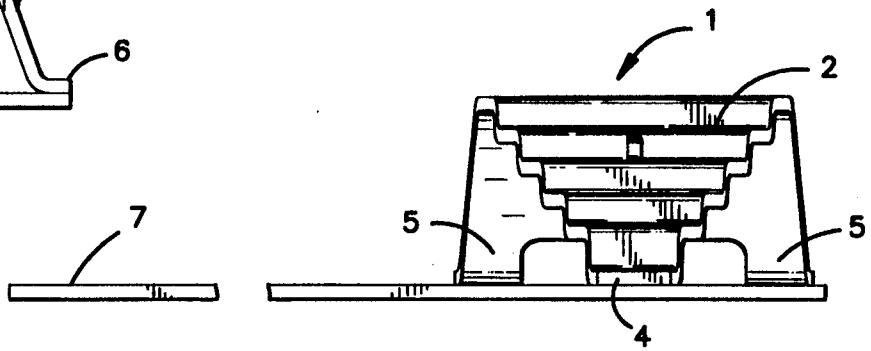
FIG. 3 is a front elevation (as seen from a wall in use)
Figure 4:
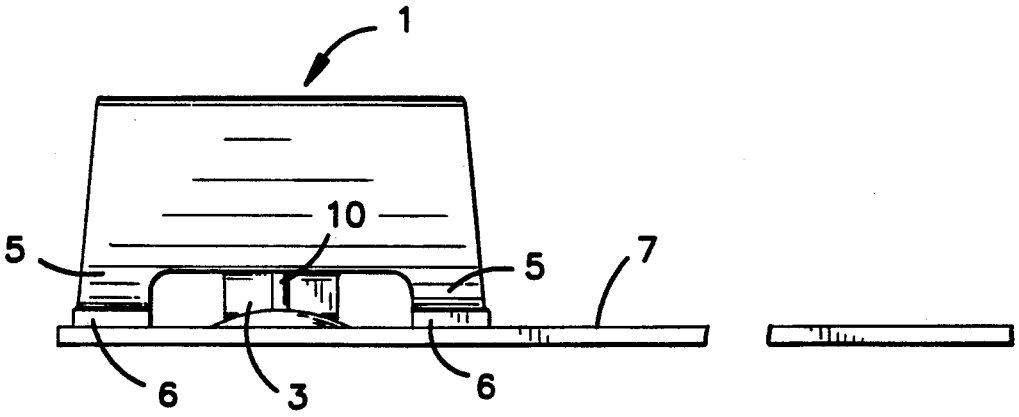
FIG. 4 is a rear elevation.
Figure 5:
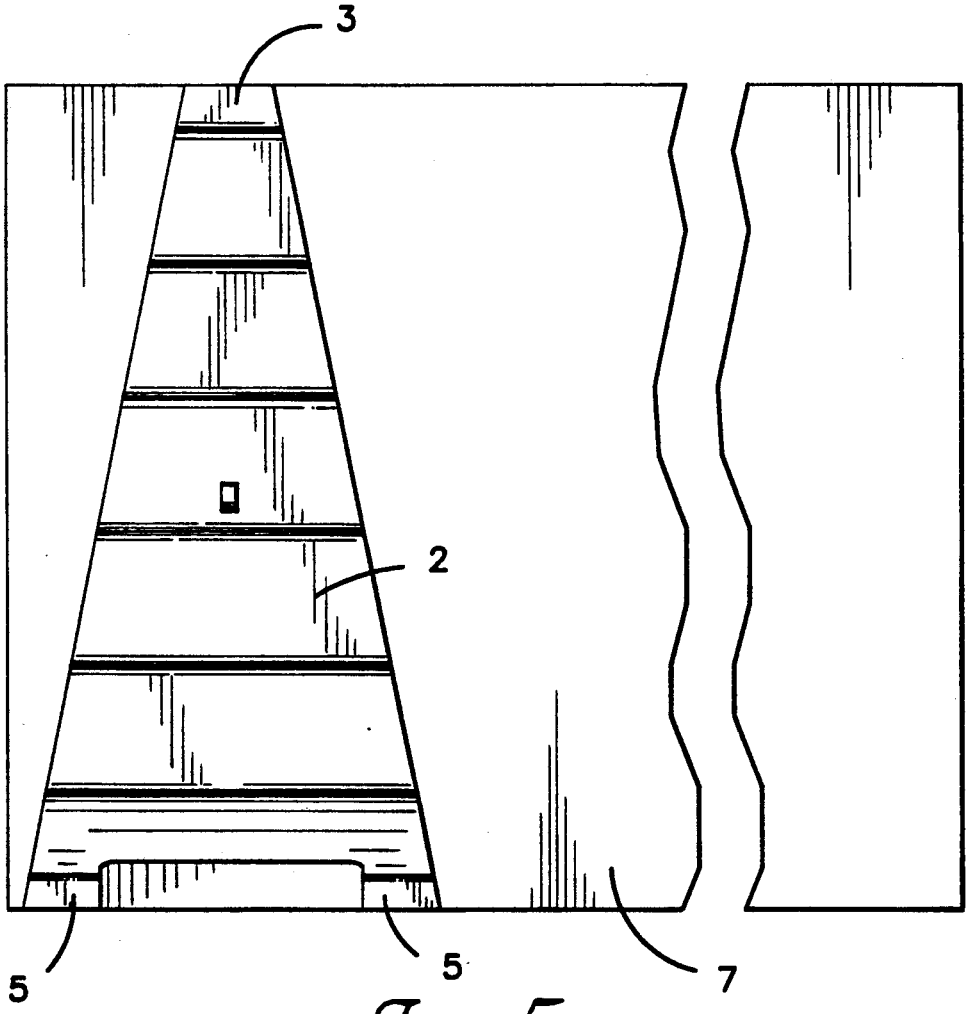
FIG. 5 is a plan.

A ramp portion 1 formed from folded mild steel plate has a stepped upper surface 2 which, as seen in the plan, is virtually an isosceles triangle with its lowest corner being an apex 3 folded to form a horizontal foot 4. The other two equally highest corners of the upper surface 2 are supported by integral legs 5 which are folded to form horizontal feet 6. The feet 4 and 6 are at rest on one end of a flat flexible rectangular mat 7 with the feet 6 located adjacent to one longer edge of the mat 7, and the foot 4 located adjacent to the opposite edge thus ensuring a stable triple support and slip resistant contact between the ramp portion 1, the mat 7 and the ground beneath.

A hole 8 in the middle of the upper surface 2 is aligned with a hole 9 in the mat 7 to accommodate a pin 10 for rotatably connecting the ramp portion 1 to the mat. It will be noted that, as shown in the drawings, the left hand stile of a ladder may be rested on the ramp portion 1 facing the wall and the right hand stile on the flat portion of the mat. Moving the bottom of both ladder stiles backwards or forwards relatively to the wall alters the supported height from the ground of the left ladder stile relatively to the right stile. If, however, the ramp portion 1 is swivelled through 180°, and the whole mat is turned through 180°, the right hand ladder stile may be similarly placed on the ramp portion 1 instead, for use when the ground is sloping laterally in the other direction.

The mat may be cut from available sheeting of rubber or other flexible plastics material. Alternatively the pin 10 and holes 8 and 9 may be omitted and the left/right handedness may be achieved by making the mat 7 as an extrusion with raised undercut lips along the longer edges to locate the feet 8 and 9. The ramp portion 1 could then be slidable from end to end of the mat for left/right hand changeover. The resultant variability of the location of the ramp portion 1 would extend the life of the device.

Alternatively a rotatable ramp portion of square shape over-lying one end of the elongate mat, and with a single highest and single lowest corner diagonally opposite one another would offer a given limited range of adjustment over significantly smaller depth of mat material. Swivelling 90° would provide reorientation for left/right handedness. However, because of the instability of four cornered support over uneven ground the ramp portion would need to be somewhat flexible or limited in size.

I claim:

1. A ladder levelling device comprising a flexible mat (7) for laying in position on the ground, the upper surface of the mat being provided with a graded range of heights (2) from the ground, the arrangement being such that both ladder legs may simultaneously be placed upon the surface and, by altering the position of one or both legs relatively to the upper surface, the legs may be spaced at mutually varying different heights from the ground.

2. A device according to claim 1, in which the upper surface of the mat (7) provides a substantially flat portion for supporting one ladder leg.

3. A device according to claim 2, in which the graded range of heights is provided by a separate ramp portion (1) which is located on the mat but adjustable to allow for right or left-handed operation.

4. A device according to claim 3, wherein the mat is elongate and the ramp portion (1) is rotatably mounted on one end of the mat.

* * * * *